US008621993B1

(12) United States Patent
Ames et al.

(10) Patent No.: US 8,621,993 B1
(45) Date of Patent: Jan. 7, 2014

(54) SYSTEM AND METHOD FOR A BALING MACHINE SAFETY ACTUATOR

(75) Inventors: Aaron Ames, Tempe, AZ (US); Anthony Tiedemann, Chandler, AZ (US); Franco Santamaria, Phoenix, AZ (US); Victor Rodriguez-Lopez, Phoenix, AZ (US); Rogelio Saucedo, Phoenix, AZ (US); Felipe Carrillo, Gilbert, AZ (US)

(73) Assignee: Tiedemann Globe Incorporated, Phoenix, AZ (US)

( * ) Notice: Subject to any disclaimer, the term of this patent is extended or adjusted under 35 U.S.C. 154(b) by 332 days.

(21) Appl. No.: 13/031,553

(22) Filed: Feb. 21, 2011

(51) Int. Cl.
*B30B 13/00* (2006.01)

(52) U.S. Cl.
USPC ..... 100/341; 100/223; 100/347; 100/348

(58) Field of Classification Search
USPC ..... 100/223, 341, 342, 347, 348
See application file for complete search history.

(56) References Cited

U.S. PATENT DOCUMENTS

| | | | | |
|---|---|---|---|---|
| 3,805,693 | A * | 4/1974 | Neitzel et al. | 100/255 |
| 4,136,609 | A * | 1/1979 | Van Doorn et al. | 100/51 |
| 4,323,136 | A * | 4/1982 | van der Lely et al. | 180/271 |
| 5,479,766 | A * | 1/1996 | Ransom | 56/341 |
| 5,493,963 | A | 2/1996 | Curles et al. | |
| 5,819,645 | A | 10/1998 | Sutton | |
| 6,239,423 | B1 | 5/2001 | Hama et al. | |
| 6,742,448 | B1 | 6/2004 | Davis et al. | |
| 6,799,086 | B2 * | 9/2004 | Toki | 700/245 |
| 7,007,598 | B1 | 3/2006 | Patras | |
| 7,130,497 | B2 | 10/2006 | Goernemann | |
| 7,404,355 | B2 * | 7/2008 | Viaud et al. | 100/4 |
| 7,729,511 | B2 | 6/2010 | Wohler et al. | |
| 2002/0183008 | A1 * | 12/2002 | Menard et al. | 455/66 |
| 2004/0200367 | A1 | 10/2004 | Lacobucci | |
| 2009/0107102 | A1 * | 4/2009 | Biziorek | 56/341 |
| 2010/0024496 | A1 * | 2/2010 | Wolfish et al. | 70/277 |
| 2010/0132428 | A1 * | 6/2010 | Braun | 72/455 |

* cited by examiner

*Primary Examiner* — Dana Ross
*Assistant Examiner* — Onekki Jolly
(74) *Attorney, Agent, or Firm* — Booth Udall Fuller, PLC

(57) ABSTRACT

A safety actuator apparatus for a baling machine comprising an extension member coupled to a baling machine having at least one baling chamber, the extension member having at least one end extending outwardly from the baling machine and a support member comprising a safety actuated retention component that aligns with and is configured to contact and restrain the at least one end of the extension member. The apparatus further comprises a detection device for identifying the presence of an obstacle in a predetermined path or a trajectory of movement of at least one component of the baling machine and a communication device configured to send a signal from the detection device to the safety actuated retention component and engage the safety actuated retention component to restrain the movement of at least one component of the baling machine.

18 Claims, 3 Drawing Sheets

SYSTEM AND METHOD FOR A BALING MACHINE SAFETY ACTUATOR

BACKGROUND

1. Field of the Invention

The present invention relates to baling equipment safety devices or mechanisms and related methods which protect operators from potential injury incurred by movement of the equipment or components of the equipment during operation or positioning of the baling equipment.

2. Description of Related Art

A baling machine is capable of compacting various types of material into a bale and requires the movement of various large components that pose a significant safety risk to the operators of the equipment. This safety risk is a concern to employers, employees and national safety institutions.

While there are multiple manufacturers, types and designs of baling machines, many components are similar among them. One example of a common type of baling machine has two chambers attached to each other about an axis. This enables the machine to rotate between two positions. The first position is a loading position where textiles, waste, recyclable or other materials are loaded into one of the chambers. The first chamber is then rotated to a second position where the material is compacted and baled and the second chamber is simultaneously rotated into the first position. This allows for the compaction of the material in the first chamber, while the second chamber is simultaneously being loaded with material. The rotation of the two chambers about the axis continues between the two positions as the operation of loading, compacting and baling proceeds.

So as to reduce the complexity and length of the Detailed Specification, and to fully establish the state of the art in certain areas of technology, Applicants herein expressly incorporate by reference all of the following materials identified in each numbered paragraph below.

U.S. Pat. No. 6,239,423 (Hama) discloses area sensors including a light emitter having a plurality of light emitting devices for placement around a pressing machine.

U.S. Pat. No. 5,819,645 (Sutton) discloses an electrical safety circuit which is incorporated into a standard vertical baler operational circuit of the type which actuates the ram cycle of a baler.

U.S. Pat. No. 7,007,598 (Patras) discloses a trash compactor including a blocking mechanism to an access port during compaction using various sensors.

U.S. Pat. No. 6,742,448 (Davis) discloses a compaction apparatus with magnetic locks and position sensors which for locking, releasing, and sensing the position of a loading door and a bale chamber door.

U.S. Pat. App. No. 20040200367 (Iacobucci) discloses a waste compactor with sensors to detect compaction material and that the compaction area doors are closed.

Applicants believe that the material incorporated above is "non-essential" in accordance with 37 CFR 1.57, because it is referred to for purposes of indicating the background of the inventions or illustrating the state of the art. However, if the Examiner believes that any of the above-incorporated material constitutes "essential material" within the meaning of 37 CFR 1.57(c)(1)-(3), Applicants will amend the specification to expressly recite the essential material that is incorporated by reference as allowed by the applicable rules.

SUMMARY

The operation of a baling machine requires safety mechanisms to avoid injury to operators and also to avoid damage to objects or to the machine itself during operation. Safety mechanisms prevent the machine and components of the machine from moving when obstacles are in potential hazardous areas during processing. These mechanisms may be incorporated on as manufactured baling equipment or added to existing equipment to ensure equipment operation proceeds in a safe manner.

Implementations of a safety actuator apparatus for a baling machine with at least one baling chamber may comprise an extension member attached to the baling machine with one end of the extension member that protrudes or extends from the baling machine. A separate support member is part of frame work outside of the baling machine and includes a safety actuated retention component. This component aligns with the one end of the extension member and is capable of contacting and restraining the baling machine by restraining the attached extension member.

Particular implementations may comprise one or more of the following features. A detection device in the surrounding area of the baling equipment and capable of identifying the presence of an obstacle in a predetermined path or trajectory of movement of a component of the baling machine. Implementations may further comprise a communication device configured to send a signal from the detection device to the safety actuated retention component and engage the safety actuated retention component to restrain the movement of at least one component of the baling machine. This occurs when an obstacle, such as a human or an object, is within the predetermined path or trajectory of movement of the baling machine or component of the baling machine. This movement of the machine or a component of the machine includes rotation about a central axis.

Particular implementation of the safety actuated retention component of the safety actuator apparatus of the baling machine may have at least one retraction arm. This arm may be actuated by pneumatics and include a spring loaded mechanism. Implementations may further comprise the safety actuated retention component secured to the separate support member by a frame sleeve that allows the retention component to engage and disengage the one end of the extension member. The engagement or disengagement of the retention component restrains or allows movement of the baling machine. In other implementations the retention component may have two extension arms with a support connecting the two arms forming a U-shaped channel. These two extension arms are configured to extend around the at least one end of the extension member to restrain the movement of at least one component of the baling machine in at least two directions. Implementations may further comprise extension arms that include a sloped protrusion that contacts the end of the extension member and as the extension member moves along with the baling equipment, it causes the progressive retraction of the extension arm. The retraction of this arm is at least a distance in height equal to the slope of the sloped protrusion.

Further implementations may comprise a detection device that is an opto-electric device such as a light curtain. It will detect obstacles in the predetermined path or trajectory of at least one component of the baling machine but may also detect obstacles between moving components or between moving and stationary components of the baling machine.

Particular implementations of a safety actuator apparatus are also for a baling machine with at least two baling chambers configured to alternate between at least two predetermined processing positions. An extension member is attached to the baling machine and one end extends outwardly from the baling machine and is configured to contact a safety actuated retention component when the baling chambers alternate between the at least two predetermined processing positions.

Other implementations comprise a detection device employed to recognize the presence of an obstacle in a predetermined path or trajectory of movement of at least one component of the two chambered baling machine. A communication device implemented to send a signal from the detection device to the safety actuated retention component. This signal will engage the safety retention component and restrain the movement of at least one component of the baling machine. Implementations may further comprise a detection device that is an opto-electric device and will detect an obstacle within a predetermined path of the movement of the baling machine, including rotation of the two baling chambers about a central axis.

Implementations may further comprise a safety actuated retention component that includes at least one retractable extension arm to engage and disengage the extension member. The engagement of the retractable extension arm may be actuated through pneumatics or spring loading or both. Other implementations may include two extension arms that form a U shaped channel to engage and disengage one end of the extension member. These arms restrain movement of the baling machine in at least two directions with the end of the extension arm restrained between the two extension arms. Implementations may further comprise at least one extension arm that includes a sloped protrusion configured to contact the at least one end of the extension member. This implementation would allow progressive retraction of the extension arm at least a distance in height equal to the slope of the sloped protrusion.

A method for activating a safety actuator apparatus of a baling machine may comprise various steps including configuring the baling machine with a safety actuator apparatus. Methods may further comprise engaging the safety actuator apparatus including detecting an obstacle in a predetermined path or trajectory of movement of at least one component of the baling machine. The method of engaging may include signaling a safety actuated retention component of the safety actuator apparatus based on detecting an obstacle in the predetermined path or trajectory of the baling machine. The method of activating may further comprise of the steps of engaging the safety actuated retention component and restraining the movement of the baling machine or a component of the baling machine. The method of activating may further comprise detecting movement of the machine itself but may further comprise the step of detecting obstacles between different components of the baling machine during movement of the baling machine in a predetermined path or trajectory.

Aspects and applications of the disclosure and inventions presented here are described below with reference to the Drawings and the Detailed Description. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

Further, the inventors are fully informed of the standards and application of the special provisions of 35 U.S.C. §112, ¶ 6. Thus, the use of the words "function," or "step" in the Detailed Description or Description of the Drawings or claims is not intended to somehow indicate a desire to invoke the special provisions of 35 U.S.C. §112, ¶ 6, to define the invention. To the contrary, if the provisions of 35 U.S.C. §112, ¶ 6 are sought to be invoked to define the inventions, the claims will specifically and expressly state the exact phrase "step" will also recite the word "function", without also reciting in such phrases any structure, material or act in support of the function. Moreover, even if the provisions of 35 U.S.C. §112, ¶ 6 are invoked to define the claimed inventions, it is intended that the inventions not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

In the following description, and for the purposes of explanation, numerous specific details are set forth in order to provide a thorough understanding of the various aspects of the safety actuator apparatus for a baling machine. It will be understood, however, by those skilled in the relevant arts, that the present invention may be practiced without these specific details. In other instances, known structures and devices are shown or discussed more generally in order to avoid obscuring the invention. It should be noted that there are many different and alternative configurations, devices and technologies to which the disclosed inventions may be applied. The full scope of the inventions is not limited to the examples that are described below.

BRIEF DESCRIPTION OF THE DRAWINGS

A more complete understanding of the present invention may be derived by referring to the detailed description when considered in connection with the following illustrative figures. In the figures, like reference numbers refer to like elements or acts throughout the figures.

Elements and acts in the figures are illustrated for simplicity and have not necessarily been rendered according to any particular sequence or embodiment.

DETAILED DESCRIPTION

Safety mechanisms for baling equipment often function to protect an operator from the compacting and baling mechanisms of the baling equipment but there is also risk to operators during movement of the baling equipment itself. Referring to a dual chamber rotating baler design, operators that work in the path of chamber rotation to strap or unload bales require safety mechanisms to reduce the risk of injury during movement of the equipment. Baling equipment is often large in size and heavy and safety mechanisms must be able to restrain the equipment from movement once an obstacle, such as an operator, is within the predetermined path or trajectory of the machine. Although a dual chambered machine frequently used in the baling industry, all designs require moving components and therefore safety devices are imperative to the industry regardless of the baling machine design.

Figure 1:
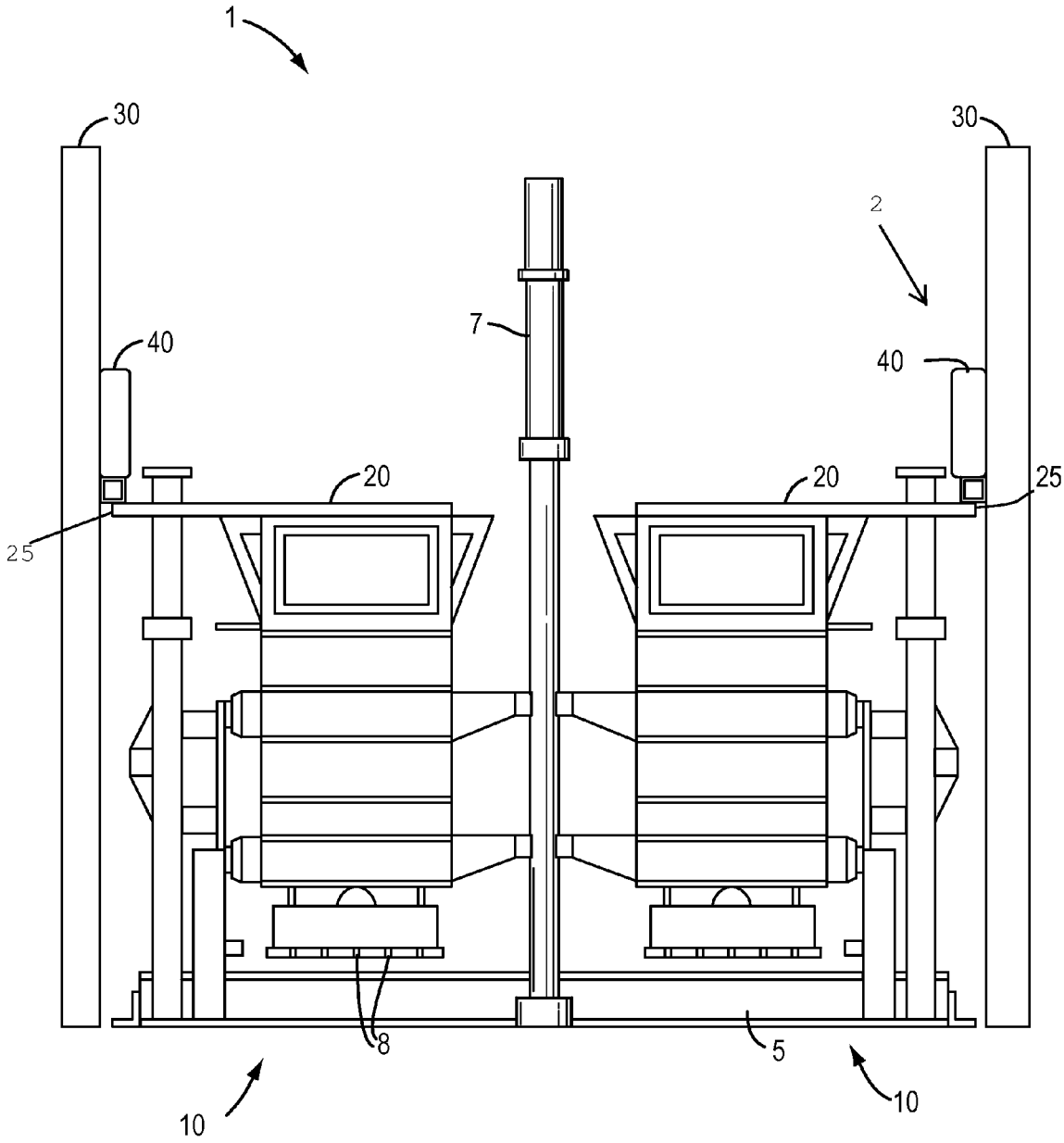
FIG. 1 depicts an implementation of a safety actuator apparatus including an embodiment of a baling machine.

FIG. 1 depicts an implementation of the present invention including a front view of a baling machine 1 and a safety actuator apparatus 2. In this embodiment, the baling machine 1 depicted includes two baling chambers 10 but a baling machine 1 with one or with multiple chambers or other components not featured in this implementation is contemplated for the present invention. The fixed base 5 of the baling machine along with a central axle 7 allows the rotation of the chambers 10 into different positions about the central axle 7. The rotation may or may not occur in only one direction about the axle 7 and may be of any degree between 0 and 360. In other embodiments, it is contemplated that the baling machine 1 may move positions by a sliding, lifting or any other mechanism and in any direction without deviating from the intent of the present invention. All details of all components of a baling machine are not necessarily relevant to the configuration of the present invention.

Figure 2:
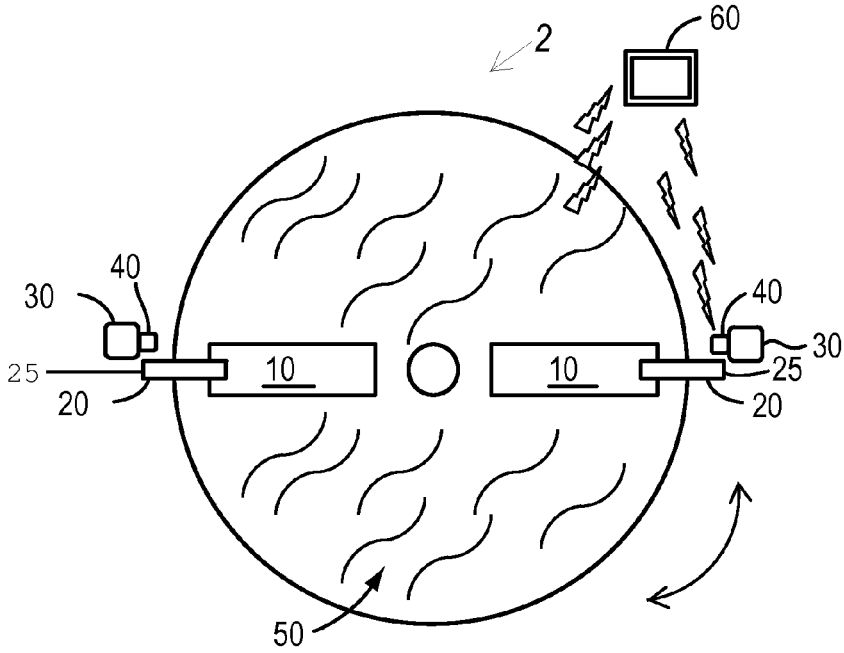
FIG. 2 depicts a top view of an implementation of a safety actuator apparatus including a representation of two baling chambers of a baling machine.

The components of the safety actuator apparatus 2 depicted in FIGS. 1 and 2 include two extension members 20, each with an end 25 extending outwardly from the baling machine 1 and two separate support members 30 with safety actuator retention components 40 secured to each separate support member 30. Details of a safety actuator retention component 40 are provided in FIG. 3. FIG. 1 also includes a representation of strapping channels 8 beneath baling chambers 10 of the baling machine 1. Typically, areas near strapping channels 8 and the baling machine chambers 10 are the critical safety areas where operators process materials and are relevant to the need for a safety actuator apparatus 2.

FIG. 2 depicts a top view of an embodiment of the safety actuator apparatus 2, the baling machine 1 and a detection device 50. The detection device 50 in this embodiment covers a 360 degree target area about the center axle 7 and within the perimeter of the exterior of the baling machine dual chamber rotation 9. The detection device 50 in this embodiment is an opto-electric device such as a light curtain but the present invention could employ a detection device 50 using any other method such as laser, magnetic or thermal technologies to detect an obstacle in a target area. Extension members 20 are attached to the sides and top of the baling chambers 10. The extension members 20 may be fabricated from multiple materials and include various constructions and designs. Non limiting material examples of the extension members include wood, steel, iron or polymeric materials. Non limiting designs include hollow square iron, rod iron, solid shafts, or steel pipes.

The baling equipment in FIG. 1 is a dual chambered baler but single chambered, multi-chambered or any other baler configuration is an appropriate implementation for use with the present safety actuator apparatus. Additionally, although all components of the safety actuator apparatus are used for baling equipment, use of any or all components of the safety apparatus with equipment or machines other than baling machines does not depart from the scope of the present invention.

FIG. 2 also depicts two separate support members 30 positioned on the exterior of the perimeter of the baling machine 1 chamber rotation. The positioning of these posts may be at any distance around the perimeter of the rotation of the baling machine. In this embodiment, the two separate support members 30 are vertical posts secured to the floor; however, one of ordinary skill in the art will recognize that any other appropriate support member configuration may also be used. Each post includes an attached safety retention component 40. The safety actuated retention components 40 are positioned on the support members 30 to align with the extension members 20 or the ends of the extension arms 25. This alignment is such that the rotational horizontal movement of the extension members 20 about the central axle 7 will cause the extension members 20 or the ends of the extension members 25 to engage safety retention components 40.

The chambers 10 of baling machine 1 represented in FIG. 2 are positioned in one of two predetermined processing positions, where material is loaded in a chamber 10 while other material may be baled simultaneously in a second chamber 10. A second predetermined processing position is 180 degrees opposite the first position where material is loaded a chamber 10 and while other material may be baled simultaneously in a second chamber 10. The embodiment of FIG. 2 depicts a placement of support members 30 in a position where extension arms 20 could engage safety actuated retention components 40 at a short distance after a predetermined position or its inverse. Engagement of the respective extension arms 20 with the respective retention component 40 depends on the rotation direction about the central axis 7. The placement of the support members 30 in FIG. 2 are not limiting and implementations of the present invention include any number of support members 30 and locations at which the support members could be placed around a baling machine 1. Furthermore, various designs of support members and locations of those support members are contemplated based on the configuration of a baling machine that slides, lifts or moves in a path other than rotation.

Figure 3:
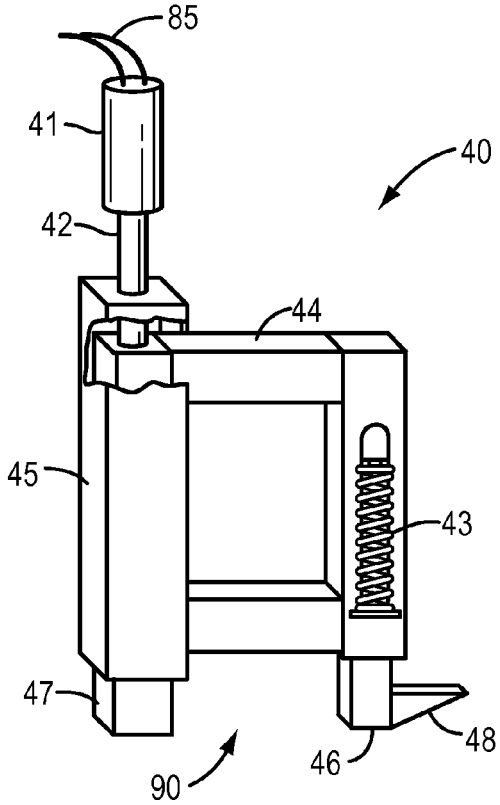
FIG. 3 depicts an embodiment of a safety actuated retention component of a safety actuator apparatus.

FIG. 3 depicts an implementation of a safety actuated retention component 40 including an air cylinder 41, a retention component frame 45, and a retention component body 44. The retention component body 44 includes two extension arms 46 and 47 where extension arm 46 includes an angled extension arm protrusion 48 and a spring loaded mechanism 43. When the safety actuated retention component 40 extends the two extension arms 46 and 47 through piston 42 and pneumatics 85 of air cylinder 41, a U-shaped channel 90 is formed to restrain the extension members 20 or the ends of the extension members 25 between the retention component body 44 and the two extension arms 46 and 47.

In FIG. 3, the angled protrusion 48 on extension arm 46 and the spring loaded mechanism 43 connects extension arm 46 with the retention component body 44 and facilitate engagement with the extension members 20. These elements enable the end 25 of extension member 20, to pass into the U-shaped channel 90 when the safety actuated retention component 40 is engaged. The end 25 of extension member 20 is engaged in the U-shaped channel 90 as the extension member travels horizontally along the perimeter of the chamber rotation in a clockwise direction (see FIG. 2). As rotation continues, the spring loaded mechanism 43 and the force of the contact of end 25 of the extension member 20 with the angled protrusion 48 on the bottom of the extension arm 46 allows extension arm 46 to retract into the retention component body 44. Once the end 25 of extension member 20 has rotated past the bottom of extension arm 47, the spring loaded mechanism 43 causes extension arm 46 to spring back out and retain end 25 of the extension member 20 within the U-shaped channel 90.

The embodiment of the safety actuated retention component 40 represented in FIG. 3 is not a limiting example as other implementations of a retention component are possible. The retention component may include, for example, a single extension arm with a latching mechanism, magnetic forces, ball and socket or other restraining mechanisms. Additionally, the safety retention component 40 in FIG. 3 is not limited to use with only baling equipment. Numerous other types of equipment and machinery that require safety mechanisms to restrain physical movement of the equipment or machine could integrate this component and other various aspects of the present invention to improve the safe operation of the equipment or machine.

Figure 4:
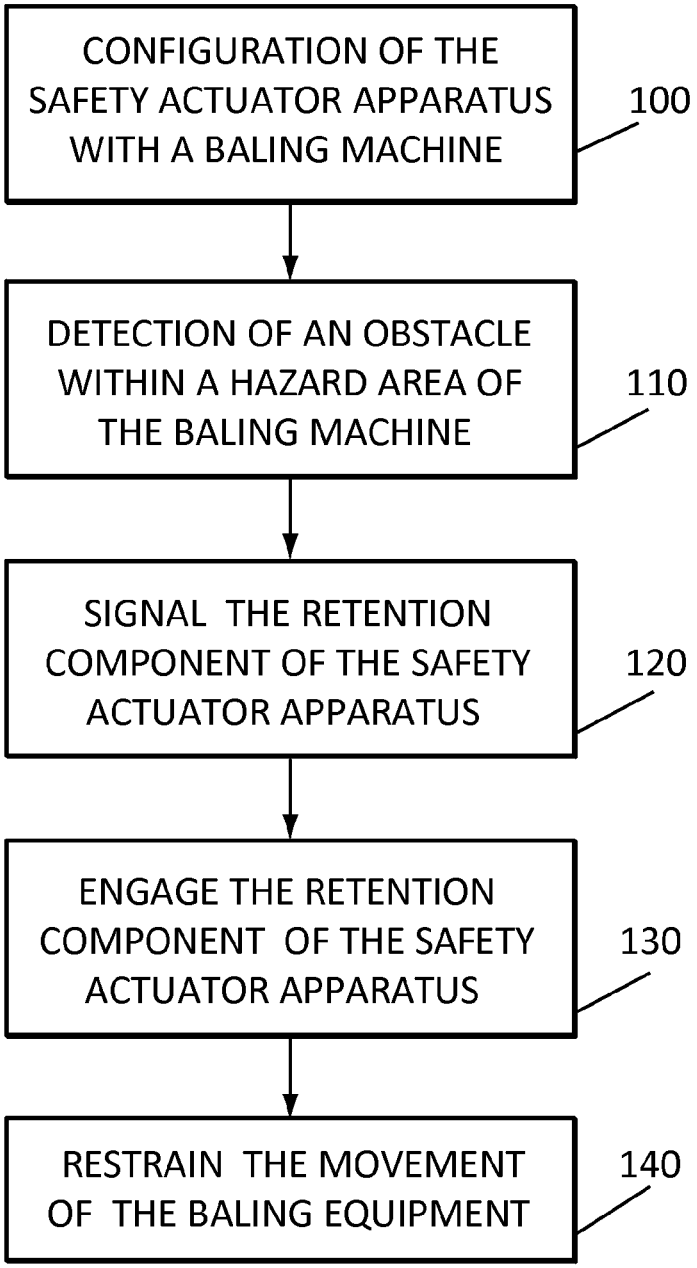
FIG. 4 is a block diagram of a method of engaging a safety actuator apparatus for a baling machine.

FIG. 4 is a block diagram for a method of engaging a safety actuator apparatus 2. This method begins by installing a safety actuator apparatus 100 such as those described in embodiments above. Once the safety actuator apparatus has been installed, an obstacle that is within a predetermined path or trajectory of movement of at least one component of a baling machine is detected 110. As implementations described previously, the detection may be made by opto-electric sensors such as by non-limiting example, a light curtain or other devices such as safety laser scanners. After an obstacle is detected, a communication device signals the safety actuated retention component of the safety actuator apparatus 120. In the present embodiment, the communication device 60 converts the signals from opto-electric sensors to one or more pneumatic actuators, as is well known in the art of light curtains. In the present embodiment, the safety actuated retention component then engages a piston of the pneumatic actuator 130 to extend two extension arms that restrain the movement of at least one component of a baling machine 140.

The communication device 60 of FIG. 2 is one of many communication devices known to a person having skill in the art of opto-switches that enable opto-electric signal conversion to pneumatics or other signals. Low voltage switches, fiber optic links or other signal conversion communication devices are contemplated in the present invention.

It will be understood that implementations are not limited to the specific components disclosed herein, as virtually any components consistent with the intended operation of the various implementations may be utilized. Accordingly, for example, it should be understood that, while the drawing figures and accompanying text show and describe particular embodiments and implementations, components may comprise any shape, size, style, type, model, version, class, grade, measurement, concentration, material, weight, quantity, and/or the like consistent with the intended operation of a methods and/or system implementations.

The concepts disclosed herein are not limited to the specific implementations shown herein. For example, it is specifically contemplated that the components included in particular implementations may be formed of any of many different types of materials or combinations that can readily be formed into shaped objects and that are consistent with the intended operation of the implementations.

In places where the description above refers to particular implementations, it should be readily apparent that a number of modifications may be made without departing from the spirit thereof and that these implementations may be applied to other implementations disclosed or undisclosed. The accompanying claims are intended to cover such modifications as would fall within the true spirit and scope of the disclosure set forth in this document. The presently disclosed implementations are, therefore, to be considered in all respects as illustrative and not restrictive, the scope of the disclosure being indicated by the appended claims rather than the foregoing description. All changes that come within the meaning of and range of equivalency of the claims are intended to be embraced therein.

The invention claimed is:

1. A safety actuator apparatus for a baling machine comprising:

an extension member coupled to a baling machine having at least one baling chamber, the extension member having at least one end extending outwardly from the baling machine;

a support member comprising a safety actuated retention component that aligns with and is configured to contact and restrain the at least one end of the extension member;

a detection device for identifying the presence of an obstacle in a predetermined path or a trajectory of movement of at least one component of the baling machine; and a communication device configured to send a signal from the detection device to the safety actuated retention component and engage the safety actuated retention component to restrain the movement of at least one component of the baling machine;

wherein the safety actuated retention component comprises a frame sleeve that secures the safety actuated retention component to the support member and is configured to allow the safety actuated retention component to engage and disengage the at least one end of the extension member.

2. The safety actuator apparatus of claim 1, wherein the movement of at least one component of the baling machine is in rotation about a central axis.

3. The safety actuator apparatus of claim 1, wherein the safety actuated retention component has at least one retractable arm.

4. The safety actuator apparatus of claim 1, wherein the detection device is an opto-electric device.

5. The safety actuator apparatus of claim 1, wherein the detection device identifies an obstacle located between components of the baling machine within the predetermined path or trajectory of movement of the baling machine.

6. The safety actuator apparatus of claim 1, wherein the safety actuated retention component is spring loaded and pneumatically activated.

7. A safety actuator apparatus for a baling machine comprising:

an extension member attached to a baling machine having at least two baling chambers configured to alternate between at least two predetermined processing positions, the extension member having at least one end extending outwardly from the baling machine;

a support member including a safety actuated retention component that aligns with and is configured to contact the at least one end of the extension member when the baling chambers alternate between the at least two predetermined processing positions;

a detection device for identifying the presence of an obstacle in a predetermined path or trajectory of movement of at least one component of the baling machine; and a communication device configured to send a signal from the detection device to the safety actuated retention component and engage the safety retention component to restrain the movement of at least one component of the baling machine;

wherein the safety actuated retention component includes a frame sleeve that secures the safety actuated retention component to the support member and is configured to allow the safety actuated retention component to engage and disengage the at least one end of the extension member.

8. The safety actuator apparatus of claim 7, wherein the movement of at least one component of baling machine is in rotation about a central axis.

9. The safety actuator apparatus of claim 7, wherein the safety actuated retention component has at least one retractable arm.

10. The safety actuator apparatus of claim 7, wherein the detection device is an opto-electric device.

11. The safety actuator apparatus of claim 7, wherein the detection device identifies an obstacle located between components of the baling machine within the predetermined path or trajectory of movement of the baling machine.

12. The safety actuator apparatus of claim 7, wherein the safety actuated retention component is spring loaded and pneumatically activated.

13. A safety actuator apparatus for a baling machine comprising:

an extension member coupled to a baling machine having at least one baling chamber, the extension member having at least one end extending outwardly from the baling machine;

a support member comprising a safety actuated retention component that aligns with and is configured to contact and restrain the at least one end of the extension member;

a detection device for identifying the presence of an obstacle in a predetermined path or a trajectory of movement of at least one component of the baling machine; and a communication device configured to send a signal from the detection device to the safety actuated retention component and engage the safety actuated retention component to restrain the movement of at least one component of the baling machine wherein the safety actuated retention component has a U-shaped channel comprising at least two extension arms configured to extend around the at least one end of the extension member to restrain the movement of at least one component of the baling machine in at least two directions.

14. The safety actuator apparatus of claim 13, wherein at least one of the extension arms of the U-shaped channel includes at least one sloped protrusion configured to contact the at least one end of the extension member and allow progressive retraction of the extension arm of at least a distance equal to the height of the slope of the sloped protrusion.

15. The safety actuator apparatus of claim 13, wherein the movement of at least one component of the baling machine is in rotation about a central axis.

16. The safety actuator apparatus of claim 13, wherein the safety actuated retention component has at least one retractable arm.

17. The safety actuator apparatus of claim 13, wherein the detection device is an opto-electric device.

18. The safety actuator apparatus of claim 13, wherein the detection device identifies an obstacle located between components of the baling machine within the predetermined path or trajectory of movement of the baling machine.

* * * * *